US006588078B2

(12) United States Patent
Writt et al.

(10) Patent No.: US 6,588,078 B2
(45) Date of Patent: Jul. 8, 2003

(54) SHOELACE TYING DEVICE

(76) Inventors: Daniel E. Writt, 1 Oak Ridge, Bentonville, AR (US) 72712-6727; Kimly Sue Writt, 1 Oak Ridge, Bentonville, AR (US) 72712-6727

( * ) Notice: Subject to any disclaimer, the term of this patent is extended or adjusted under 35 U.S.C. 154(b) by 0 days.

(21) Appl. No.: 10/086,889

(22) Filed: Mar. 4, 2002

(65) Prior Publication Data

US 2003/0024088 A1 Feb. 6, 2003

Related U.S. Application Data

(60) Provisional application No. 60/309,492, filed on Aug. 3, 2001.

(51) Int. Cl.[7] ..... F16G 11/00
(52) U.S. Cl. ..... 24/712.2; 24/712.3
(58) Field of Search ..... 24/712.1, 712.3, 24/712.2, 306, 442, 712.9; 36/50.1

(56) References Cited

U.S. PATENT DOCUMENTS

| | | | | | |
|---|---|---|---|---|---|
| 1,371,637 | A | | 3/1921 | Meredith | |
| 1,549,170 | A | * | 8/1925 | Waldron | 24/712.2 X |
| 4,291,439 | A | | 9/1981 | Riti | 24/119 |
| 4,428,101 | A | * | 1/1984 | Harkavy | 24/712.4 |
| 4,553,293 | A | | 11/1985 | Blum | 24/119 |
| 4,790,048 | A | | 12/1988 | Arnt | 24/117 |
| 4,879,787 | A | * | 11/1989 | Walls | 24/712.2 |
| 4,999,888 | A | * | 3/1991 | Miller | 24/712.3 |
| 5,042,119 | A | * | 8/1991 | Williams | 24/712.3 |
| 5,170,573 | A | * | 12/1992 | Clinch | 36/50.1 |
| 5,778,500 | A | | 7/1998 | Illingworth | 24/712.3 |
| 5,913,483 | A | | 6/1999 | Polk | 24/712.3 |
| 5,979,028 | A | | 11/1999 | Hicks et al. | 24/712.9 |

* cited by examiner

*Primary Examiner*—Robert J. Sandy
(74) *Attorney, Agent, or Firm*—Welsh & Flaxman LLC

(57) ABSTRACT

A shoelace tying device including a body member having an elongated clasp and a closure member. The elongated clasp includes a first end coupled to the closure member and a free second end. The elongated clasp further includes structure for securing the elongated clasp to laces of footwear. The closure member includes a free first end and a second end coupled to the first end of the elongated clasp. The first end of the closure member and the second end of the closure member are respectively provided with mating connecting members such that the closure member may be folded along a central section to bring the connecting member of the first end of the closure member into contact with the connecting member of the second end of the closure member for selectively coupling the first end of the closure member to the second end of the closure member to form an enclosure in which shoelaces maybe retained. In use, the elongated closure is coupled to the laces between eyelets of footwear to securely couple the shoelace tying device to the footwear, the laces are tied in a conventional manner adjacent the central section of the closure member and the closure member is folded over such that the first end of the closure member is selectively coupled to the second end of the closure member enclosing the tied laces within the space defined by the folded closure member. A method for tying shoelaces to prevent the lace from becoming untied is also disclosed.

19 Claims, 3 Drawing Sheets

FIG. 5
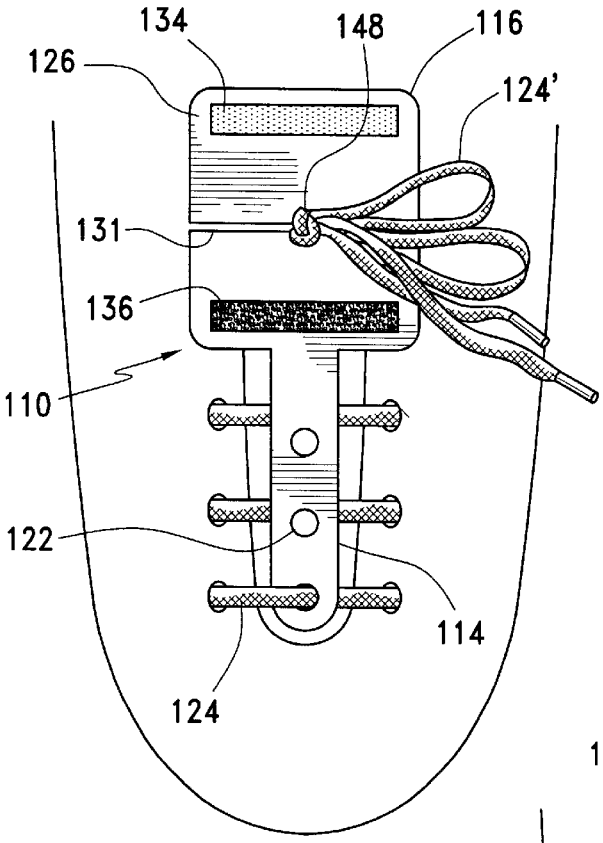
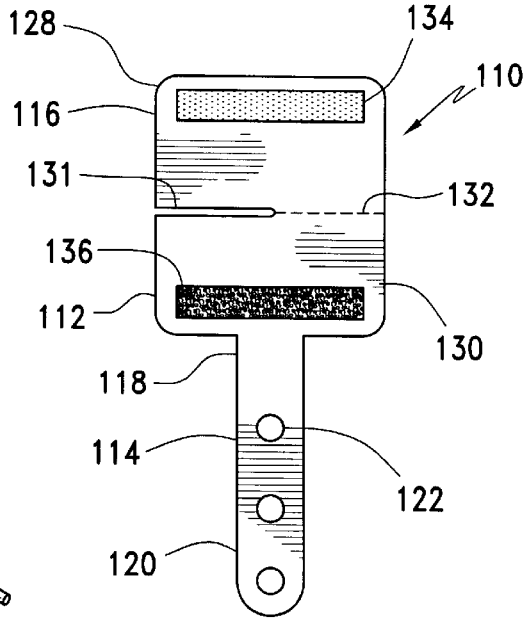
FIG. 4
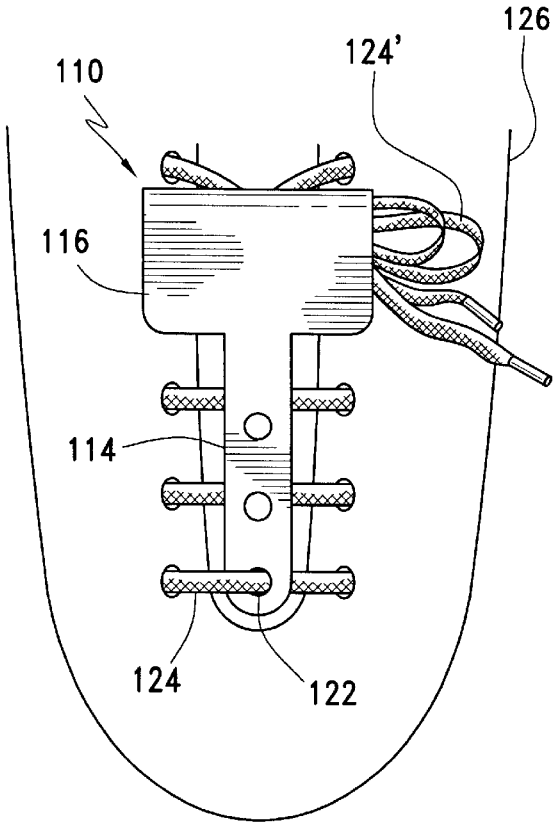
FIG. 6

SHOELACE TYING DEVICE

CROSS REFERENCE TO RELATED APPLICATIONS

This application is based upon U.S. Provisional Patent Application Serial No. 60/309,492, entitled "SHOELACE TYING DEVICE", filed Aug. 3, 2001.

BACKGROUND OF THE INVENTION

1. Field of the Invention

The invention relates to shoelace tying devices. More particularly, the invention relates to a shoelace tying device which prevents laces from becoming inadvertently untied.

2. Description of the Prior Art

Many devices have been developed to assist people in tying their shoelaces. These devices attempt to simplify the tying process and help to ensure that laces remain tied. Despite the many efforts aimed at improving upon one's ability to tie the laces of footwear, a need continues to exist for a device which offers reliability and convenience in ensuring that one's laces do not become untied once the individual begins exercising or otherwise uses the footwear. The present invention provides a device fulfilling such a need.

SUMMARY OF THE INVENTION

It is, therefore, an object of the present invention to provide a shoelace tying device including a body member having an elongated clasp and a closure member. The elongated clasp includes a first end coupled to the closure member and a free second end. The elongated clasp further includes structure for securing the elongated clasp to laces of footwear. The closure member includes a free first end and a second end coupled to the first end of the elongated clasp. The first end of the closure member and the second end of the closure member are respectively provided with mating connecting members such that the closure member may be folded along a central section to bring the connecting member of the first end of the closure member into contact with the connecting member of the second end of the closure member for selectively coupling the first end of the closure member to the second end of the closure member to form an enclosure in which shoelaces may be retained. In use, the elongated closure is coupled to the laces between eyelets of footwear to securely couple the shoelace tying device to the footwear, the laces are tied in a conventional manner adjacent the central section of the closure member and the closure member is folded over such that the first end of the closure member is selectively coupled to the second end of the closure member enclosing the tied laces within the space defined by the folded closure member.

It is also an object of the present invention to provide a method for tying shoelaces to prevent the lace from becoming untied. The method is accomplished by attaching a shoelace tying device to the laces between eyelets of footwear and enclosing the laces within the closure member of the shoe lace tying device. The closure member includes a free first end and a second end coupled to the first end of the elongated clasp, the first end of the closure member and the second end of the closure member being respectively provided with mating connecting members such that the closure member may be folded along a central section to bring the connecting member of the first end of the closure member into contact with the connecting member of the second end of the closure member for selectively coupling the first end of the closure member to the second end of the closure member to form an enclosure in which shoelaces may be retained.

It is further an object of the present invention to provide a shoelace tying device including a body member having an elongated clasp and a closure member. The elongated clasp includes a first end coupled to the closure member and a free second end. The elongated clasp further includes structure for securing the elongated clasp to laces of footwear. The closure member includes a free first end and a second end coupled to the first end of the elongated clasp. The closure member further includes a slot shaped and dimensioned for receiving laces, the slot being positioned in a central section of the closure member between the first end and the second end of the closure member. In use, laces are positioned within the slot after tying and before the closure member is folded over to enclose the laces therein.

Other objects and advantages of the present invention will become apparent from the following detailed description when viewed in conjunction with the accompanying drawings, which set forth certain embodiments of the invention.

BRIEF DESCRIPTION OF THE DRAWINGS

FIG. 4 is a further embodiment of the present shoe tying device.

FIG. 5 is top view shoeing the laces begin inserted within the slot of the shoe tying device disclosed in FIG. 4.

FIG. 6 is perspective view of the outside of a shoe with the shoe tying device shown in FIG. 4.

DESCRIPTION OF THE PREFERRED EMBODIMENTS

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

Figure 1:
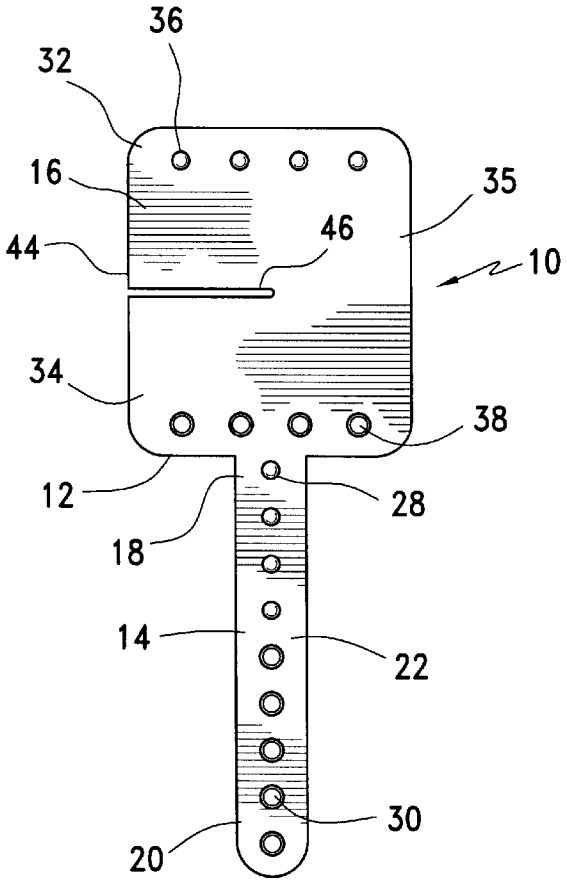
FIG. 1 is a perspective view of the shoelace tying device according to a first embodiment.
Figure 2:
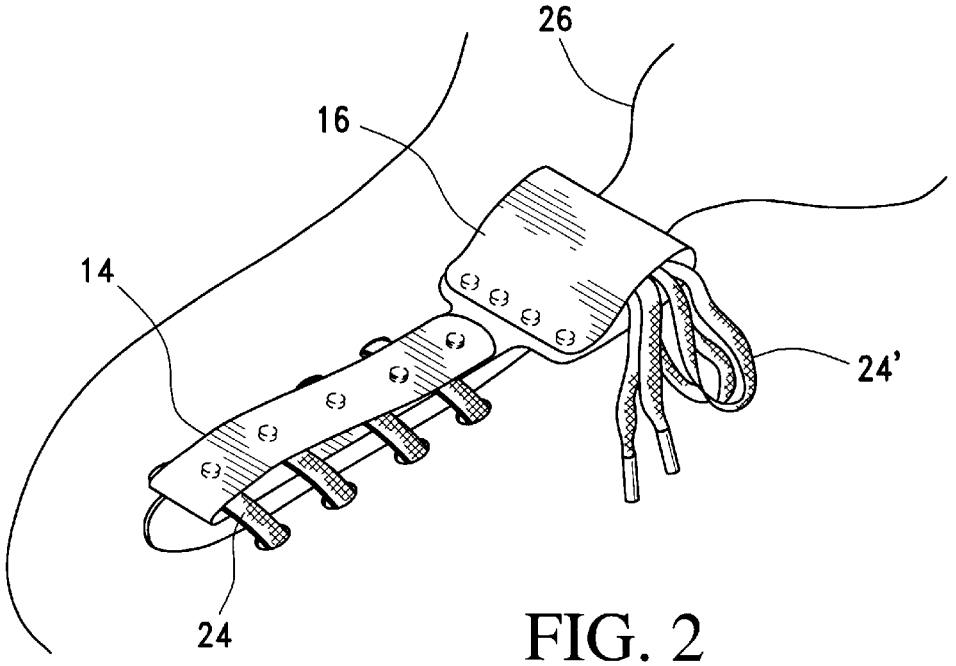
FIG. 2 is perspective view of the outside of a shoe with the shoe tying device shown in FIG. 1.

With reference to FIGS. 1 and 2, a first embodiment of the present shoelace tying device 10 is disclosed. The figures shown throughout the present disclosure show shoetying devices adapted for the left shoe. It should, however, be appreciated that shoe tying devices for the right shoe would be the mirror image of those disclosed for use with the left shoe. The shoelace tying device 10 according to this first embodiment includes a body member 12 having an elongated clasp 14 and a closure member 16. The body member 12 is formed as a one-piece unit in accordance with a preferred embodiment of the present invention. However, those skilled in the art will appreciate the many ways in which the body member 12 may be formed without departing from the spirit of the present invention.

The elongated clasp 14 includes a first end 18 coupled to the closure member 16 and a free second end 20. The elongated clasp 14 is further provided with a central portion 22 such that the first end 18 of the elongated clasp 14 maybe brought into contact with the second end 20 of the elongated clasp 14 to create a loop. As will be explained below in greater detail, the loop is positioned about laces 24 of footwear 26 to securely attach the shoelace tying device 10 to footwear 26.

With this in mind, the first end 18 of the elongated clasp 14 and the second end 20 of the elongated clasp 14 include cooperating coupling members facilitating selective attachment of the first end 18 of the elongated clasp 14 to the second end 20 of the elongated clasp 14 when the second end 20 of the elongated clasp 14 is brought into mating contact with the first end 18 of the elongated clasp 14. In accordance with a preferred embodiment of the present invention, the first end 18 of the elongated clasp 14 includes male snap members 28 and the second end 20 of the elongated clasp 14 includes female snap holes 30. As those skilled in the art will well appreciate, the male snap members 28 and the female snap holes 30 are shaped and dimensioned for selective engagement to hold the elongated clasp 14 in a looped orientation.

Figure 3:
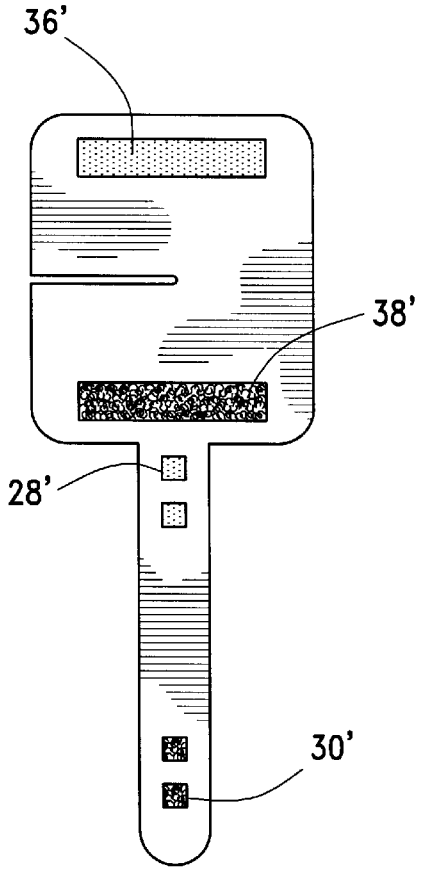
FIG. 3 is a perspective view of an alternate embodiment of the shoe tying device according to claim 1.

With reference to FIG. 3, an alternate embodiment is disclosed. In accordance with this embodiment, the male snap members 28 and female snap holes 30 are replaced with VELCRO, hook and loop type, fastening material 28', 30'.

The closure member 16 includes a free first end 32 and a second end 34 coupled to the first end 18 of the elongated clasp 14. The first end 32 of the closure member 16 and the second end 34 of the closure member 16 are respectively provided with mating connecting members such that the closure member 16 maybe folded along a central section 35 to bring the connecting member of the first end 32 of the closure member 16 into contact with the connecting member of the second end 34 of the closure member 16 for selectively coupling the first end 32 of the closure member 16 to the second end 34 of the closure member 16. This forms an enclosure in which shoelaces 24 may be retained.

In accordance with the embodiment disclosed in FIGS. 1 and 2, the mating connecting members take the form of male snap members 36 and female snap holes 38 respectively formed in the first end 32 of the closure member 16 and the second end 34 of the closure member 16. With reference to FIG. 3, an alternate embodiment is disclosed wherein the male snap members 36 and female snap holes 38 are replaced with VELCRO, hook and loop type, fastening material 36', 38'. While FIGS. 1 and 2 discloses the use of snaps and FIG. 2 discloses the use of VELCRO fastening material, these and other fastening members may be used together or in combination without departing from the spirit of the present invention.

Proper fastening of the tied laces within the closure member 16 is facilitated by the provision of a slot 40 within the central section 35 of the closure member 16. The slot 40 extends from an edge 44 of the central section 35 toward the middle 46 of the central member 16. The slot 40 is shaped and dimensioned for receiving laces 24, the laces 24 being positioned within the slot 40 after tying and before the closure member 16 is folded over to enclose the laces 24 therein. In this way, and as will be discussed in greater detail below, the slot 40 and closure 16 essential "lock" the tied laces 24 in position and prevent inadvertent untying thereof.

In general, the elongated closure 14 is coupled to the laces 24 between eyelets of footwear 26 to securely couple the shoelace tying device 10 to the footwear 26. The laces 24 are then tied in a conventional manner (forming a knot) and the portion of the laces beneath the knot is slid within the slot 40 toward the middle 46 of the closure member's central section 35. The closure member 16 is folded over such that the first end 32 of the closure member 16 is selectively coupled to the second end 34 of the closure member 16. Folding in this manner encloses the tied laces 24' within the space defined by the folded closure member 16.

A further embodiment of the present invention is disclosed in FIGS. 4, 5 and 6. As with the prior embodiments, the shoelace tying device 110 according to this embodiment includes a body member 112 having an elongated clasp 114 and a closure member 116. The elongated clasp 114 includes a first end 118 coupled to the closure member 116 and a free second end 120. The elongated clasp 114 is further provided with a series of holes 122 between the first end 118 and the second end 120 thereof. These holes 122 are shaped and dimensioned for laces 124 to pass therethrough and thereby securely couple the shoelace tying device 110 to the footwear 126.

As with the prior embodiments, the closure member 116 includes a free first end 128 and a second end 130 coupled to the first end 118 of the elongated clasp 114. The first end 128 of the closure member 116 and the second end 130 of the closure member 116 are respectively provided with mating connecting members. The closure member 116 may, therefore, be folded along a central section 132 bringing the connecting member of the first end 128 of the closure member 116 into contact with the connecting member of the second end 130 of the closure member 116 where the first end 128 of the closure member 116 is selectively coupled to the second end 130 of the closure member 116 to form an enclosure in which shoelaces 124 may be retained. The closure member 116 is also provided with a slot 131.

In accordance with the embodiment disclosed in FIGS. 4, 5 and 6, the mating connecting members take the form of cooperating VELCRO member 134, 136 respectively formed in the first end 128 of the closure member 116 and the second end 130 of the closure member 116, although other connecting structures maybe used without departing from the spirit of the present invention.

In general, the elongated closure 110 is coupled to the laces 124 between eyelets of footwear 126 by threading the laces 124 within the holes 122 formed in the elongated closure 114. The laces 124 are tied in a conventional manner (forming a knot 148) and the portion of the laces 124 beneath the knot 148 is slid within the slot 131 toward the middle 46 of the closure member's central section 35. The closure member 116 is folded over such that the first end 128 of the closure member 116 is selectively coupled to the second end 130 of the closure member 116. In this way, the tied laces 124' are enclosed within the space defined by the folded closure member 116, and essentially locked therein by the interaction between the slot 131 and the knot 148.

Figure 7:
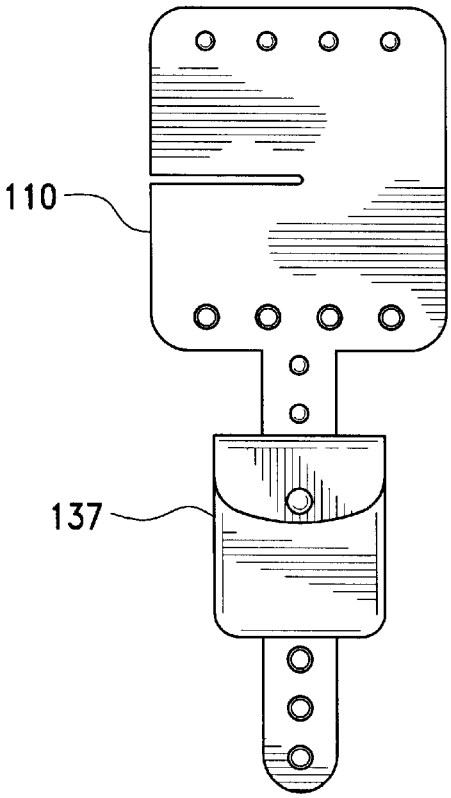
FIGS. 7, 7*a* and 8 are respectively alternate embodiments of the shoe tying devices shown in FIGS. 1 and 4 with a caddy secured thereto.
Figure 7A:
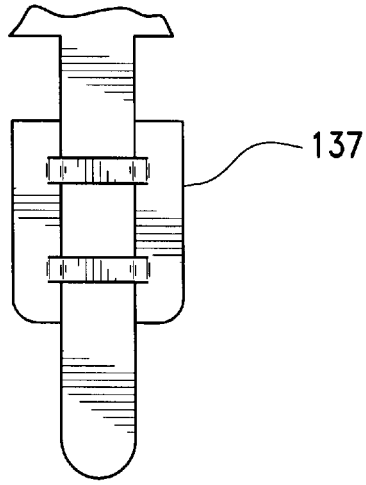
Figure 8:
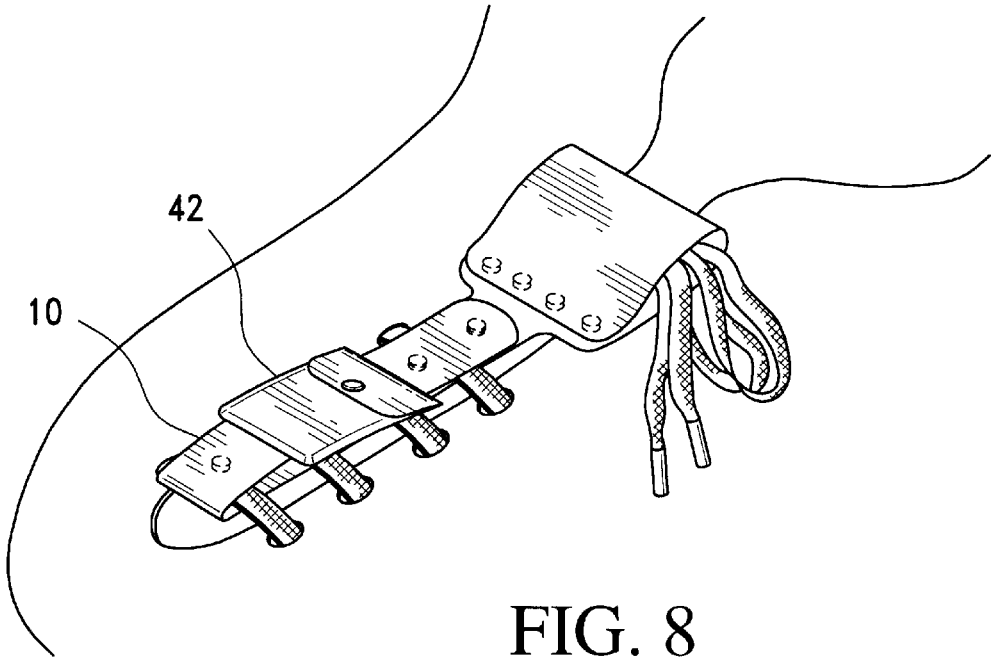

Regardless of the embodiment, the shoelace tying device 10,110 maybe further provided with a caddy 42,134 shaped and dimensioned for receiving an item to being carried by a wearer (see FIGS. 7, 7*a* and 8). In practice, the caddy 42,137 is selectively attached to the elongated clasp 14,114.

Use of the present shoelace tying device is now described. The shoelace tying device is first attached to the laces between eyelets of footwear. In accordance with the embodiment disclosed in FIGS. 4, 5 and 6, this is accomplished by sliding the elongated clasp beneath the laces, folding the second end of the elongated clasp over the laces and selectively attaching the first end of the elongated clasp to the second end of the elongated clasp. Where the embodiment disclosed in FIGS. 4, 5 and 6 is utilizes, the laces of the footwear are passed through the holes of the elongated clasp as the laces are passed from eyelet to eyelet.

The laces are then tied in a conventional manner, and the portion of the laces beneath the knot is pushed within the slot formed in the central section of the closure member (see FIG. 5, in particular). The knotted laces are then enclosed within the closure member of the shoelace tying device. This is accomplished by folding the first end of the closure member toward the second end of the closure member. The first and second ends of the closure member are then selectively secured together to form an enclosure in which the knotted laces are enclosed. Improved protection is provided if the knotted laces are moved to the side of the footwear that is on the outside of the shoe prior to closing the closure member in the manner described above. Positioning of the knotted laces in this manner also prohibits the laces from being stepped upon, which is the leading cause for untied laces.

By sliding the portion of the laces beneath the knot within the slot and closing the closure member around the tied laces, one is able to securely "lock" the laces within the present shoe tying device. For example, the closure member protects the laces from inadvertent untying, while the slot, closure member and elongated clasp work together in holding the laces in positioned relative to the present shoelace tying device. Positioning of the laces within the slot effectively retains the closure member in contact with the shoe itself and prevents relative motion which might cause inadvertent untying of the shoelaces.

While the preferred embodiments have been shown and described, it will be understood that there is no intent to limit the invention by such disclosure, but rather, is intended to cover all modifications and alternate constructions falling within the spirit and scope of the invention as defined in the appended claims.

What is claimed is:

1. A shoelace lying device, comprising:

a body member including an elongated clasp and a closure number;

the elongated clasp including a first end coupled to the closure member and a free second end, the elongated clasp further including means for securing the elongated clasp to laces of footwear;

The closure member including a free first end and a second end coupled to the first end of the elongated clasp, the first end of the closure member and the second end of the closure member being respectively provided with mating connecting members such that the closure member may be folded along a central section to bring the connecting member of the first end of the closure member into contact with the connecting member of the second end of the closure member for selectively coupling the first end of the closure member to the second end of the closure member to form an enclosure in which shoelaces may be retained;

the closure member further including a slot shaped and dimensioned for receiving shoelaces, the slot being positioned in a central section of the closure member between the first end and the second end of the closure number, the slot further extending from an edge of the closure member to a middle section of the closure member in a manner permitting the passage of shoelaces through the closure member in a direction substantially perpendicular to a plane in which the closure member lays such that one may slide previously tied shoelaces within the slot by pushing the shoelaces within the slot from the edge of the closure member to the middle section of the closure member;

wherein the elongated closure is coupled to the laces between eyelets of footwear to securely couple the shoelace tying device to the footwear, the laces are tied in a conventional manner adjacent the central section of the closure member and the closure member is folded over such that the first end of the closure member is selectively coupled to the second end of the closure member enclosing the tied laces within the space defined by the folded closure member.

2. A shoelace tying device comprising:

a body member including an elongated clasp and a closure member;

the elongated clasp including a first end coupled to the closure member and a free second end, the elongated clasp further including means for securing the elongated clasp to laces of footwear;

the closure member including a free first end and a second end coupled to the first end of the elongated clasp, the first end of the closure member and the second end of the closure member being respectively provided with mating connecting members such that the closure member may be folded along a central section to bring the connecting member of the first end of the closure member into contact with the connecting member of the second end of the closure member for selectively coupling the first end of the closure member to the second end of the closure member to form an enclosure in which shoelaces may be retained;

wherein the elongated closure is coupled to the laces between eyelets of footwear to securely couple the shoelace tying device to the footwear, the laces are tied in a conventional manner adjacent the central section of the closure member and the closure member is folded over such that the first end of the closure member is selectively coupled to the second end of the closure member enclosing the tied laces within the space defined by the folded closure member; and wherein the means for securing is achieved by providing the elongated clasp with a central portion such that the first end of the elongated clasp may be brought into contact with the second end of the elongated clasp to create a loop that may be positioned about laces of footwear, the first end of the elongated member and the second end of the elongated member including cooperating coupling members such that the first end of the elongated clasp and the second end of the elongated clasp are selectively held in a looped orientation when then second end of the elongated clasp is brought into mating contact with the first end of the elongated clasp.

3. The shoelace tying device according to claim 2, wherein the cooperating coupling members of the elongated clasp are selectively engageable snaps.

4. The shoelace tying device according to claim 2, wherein the cooperating coupling members of the elongated clasp are selectively engageable hook and loop type fasteners.

5. A shoelace tying device, comprising:

a body member including an elongated clasp and a closure member;

the elongated clasp including a first end coupled to the closure member and a free second end the elongated clasp further including means for securing the elongated clasp to laces of footwear;

the closure member including a free first end and a second end coupled to the first end of the elongated clasp, the first end of the closure member and the second end of the closure member being respectively provided with mating connecting members such that the closure member may be folded along a central section to bring the connecting member of the first end of the closure member into contact with the connecting member of the second end of the closure member for selectively coupling the first end of the closure member to the second end of the closure member to form an enclosure in which shoelaces may be retained;

wherein the elongated closure is coupled to the laces between eyelets of footwear to securely couple the shoelace tying device to the footwear, the laces are tied in a conventional manner adjacent the central section of the closure member and the closure member is folded over such that the first end of the closure member is selectively coupled to the second end of the closure member enclosing the tied laces within the space defined by the folded closure member; and wherein the means for securing includes holes fanned between the first end of the elongated clasp and the second end of the elongated clasp, the holes being shaped and dimensioned for passing laces therethrough.

6. A shoelace tying device, comprising:

a body member including an elongated clasp and a closure member;

the elongated clasp including a first end coupled to the closure member and a free second end, the elongated clasp further including means for securing the elongated clasp to laces of footwear;

the closure member including a free first end and a second end coupled to the first end of the elongated clasp, the first end of the closure member and the second end of the closure member being respectively provided with mating connecting members such that the closure member may be folded along a central section to bring the connecting member of the first end of the closure member into contact with the connecting member of the second end of the closure member for selectively coupling the first end of the closure member to the second end of the closure member to form an enclosure in which shoelaces maybe retained;

wherein the elongated closure is coupled to the laces between eyelets of footwear to securely couple the shoelace tying device to the footwear, the laces are tied in a conventional manner adjacent the central section of the closure member and the closure member is folded over such that the first end of the closure member is selectively coupled to the second end of the closure member enclosing the tied laces within the space defined by the folded closure member, and wherein mating connecting members of the closure member are selectively engageable snaps.

7. The shoelace tying device according to claim 1, wherein the mating connecting members of the elongated clasp are selectively engageable hook and loop type fasteners.

8. A shoelace tying device, comprising:

a body member including an elongated clasp and a closure member;

the elongated clasp including a first end coupled to the closure member and a free second end, the elongated clasp further including means for securing the elongated clasp to laces of footwear;

the closure member including a free first end and a second end coupled to the first end of the elongated clasp, the closure member further including a slot shaped and dimensioned for receiving laces, the slot being positioned in a central section of the closure member between the first end and the second end of the closure member;

wherein laces are positioned within the slot after tying and before the closure member is folded over to enclose the lace therein; and wherein the means for securing includes holes formed between the first end of the elongated clasp and the second end of the elongated clasp, the holes being shaped and dimensioned for passing laces therethrough.

9. The shoelace tying device according to claim 1, further including a caddy shaped and dimensioned for receiving an item to being carried by a wearer.

10. The shoelace tying device according to claim 9 wherein the caddy is selectively attached to the elongated clasp.

11. A method for tying shoelaces to prevent the lace from becoming untied, comprising the following steps:

attaching a shoelace tying device to the laces between eyelets of footwear, the shoelace tying device comprising:

a body member including an elongated clasp and a closure member having a slot formed therein, wherein the elongated clasp includes a first end coupled to the closure member and a free second end, the elongated clasp further including means for securing the shoelace tying device to the footwear;

tying the laces; and positioning the tied laces within the slot.

12. The method according to claim 11, wherein the closure member includes a free first end and a second end coupled to the first end of the elongated clasp, the first end of the closure member and the second end of the closure member being respectively provided with mating connecting members such that the closure member maybe folded along a central section to bring the connecting member of the first end of the closure member into contact with the connecting member of the second end of the closure member for selectively coupling the first end of the closure member to the second end of the closure member to form an enclosure in which shoelaces may be retained, and the method includes the further step of enclosing the laces within the closure member of the shoe lace tying device.

13. The method according to claim 11, including the further step of coupling a caddy to the shoelace tying device.

14. The method acceding to claim 11, wherein the elongated clasp is adapted for folding along a central portion thereof such that the first end of the elongated clasp may be brought into contact with the second end of the elongated clasp to create a loop that may be positioned about laces of a footwear, the first end of the elongated member and the second end of the elongated member including cooperating coupling members such that the first end of the elongated clasp and the second end of the elongated clasp are selectively help in a looped orientation when then second end of the elongated clasp is brought into mating contact with the first end of the elongated clasp; and the step of attaching includes folding the elongated clasp such that the first end of the elongated clasp is selected coupled to the second end of the elongated clasp to with the laces held within a loop defined byte elongated clasp.

15. The method according to claim 11, wherein the elongated clasp includes holes formed between the first end of the elongated clasp and the second end of the elongated clasp, and the step of attaching includes passing the laces through the holes to securely couple the shoelace tying device to the footwear.

16. A shoelace tying device, comprising:

a body member including an elongated clasp and a closure member;

the elongated clasp including a first end coupled to the closure member and a free second end, the elongated clasp further including means for securing the elongated clasp to laces of footwear;

the closure member including a free first end and a second end coupled to the first end of the elongated clasp, the closure member further including a slot shaped and dimensioned for receiving laces, the slot being positioned in a central section of the closure member between the first end and the second end of the closure member, the slot further extending from an edge of the closure member to a middle section of the closure member in a manner permitting the passage of shoelaces through the closure member in a direction substantially perpendicular to a plane in which the closure member lays such that one may slide previously tied shoelaces within the slot by pushing the shoelaces within the slot from the edge of the closure member to the middle section of the closure member;

wherein laces are positioned within the slot after tying and before the closure member is folded over to enclose the laces therein.

17. A shoelace tying device, comprising:

a body member including an elongated clasp and a closure member;

the elongated clasp including a first end coupled to the closure member and a free second end the elongated clasp further including means for securing the elongated clasp to laces of footwear;

the closure member including a free first end and a second end coupled to the first end of the elongated clasp, the closure member further including a slot shaped and dimensioned for receiving laces, the slot being positioned in a central section of the closure member between the first end and the second end of the closure member;

wherein laces are positioned within the slot after tying and before the closure member is folded over to enclose the laces therein; and wherein the means for securing is achieved by providing the elongated clasp with a central portion such that the first end of the elongated clasp maybe brought into contact with the second end of the elongated clasp to create a loop that may be positioned about laces of a footwear, the first end of the elongated member and the second end of the elongated member including cooperating coupling members such that the first end of the elongated clasp and the second end of the elongated clasp are selectively held in a looped orientation when then second end of the elongated clasp is brought into mating contact with the first end of the elongated clasp.

18. The shoelace tying device according to claim 17, wherein the cooperating coupling members of the elongated clasp are selectively engageable snaps.

19. The shoelace tying device according to claim 17, wherein the cooperating coupling members of the elongated clasp are selectively engageable hook and loop type fasteners.

* * * * *